US006932223B1

(12) United States Patent
Lee et al.

(10) Patent No.: US 6,932,223 B1
(45) Date of Patent: Aug. 23, 2005

(54) COMBINATION SUSPENSION RACK

(76) Inventors: Sung Min Lee, No. 69, Lane Fu-Hsing4, Wuguang Rd., Wur Shiang, Taichung (TW) 414; Yu Chun Lee, No. 69, Lane Fu-Hsing4, Wuguang Rd., Wur Shiang, Taichung (TW) 414

( * ) Notice: Subject to any disclaimer, the term of this patent is extended or adjusted under 35 U.S.C. 154(b) by 79 days.

(21) Appl. No.: 10/358,241

(22) Filed: Feb. 5, 2003

(51) Int. Cl.[7] ..... A47F 5/00

(52) U.S. Cl. ..... 211/70.6; 211/89.01; 211/87.01; 206/349; 206/372; 248/314; 248/315

(58) Field of Search ..... 211/70.6, 89.01, 211/60.1, 87.01, 175, 66, 65, 74, 68; 206/349, 206/372, 373, 377; 248/314, 315

(56) References Cited

U.S. PATENT DOCUMENTS

| | | | | | |
|---|---|---|---|---|---|
| 3,365,761 | A * | 1/1968 | Kalvig | 248/113 |
| 3,375,934 | A * | 4/1968 | Bates | 211/72 |
| 4,334,621 | A * | 6/1982 | Weber | 211/70.3 |
| 4,410,095 | A * | 10/1983 | Dembicks | 211/70.6 |
| 4,586,615 | A * | 5/1986 | Quitmann | 211/70.6 |
| 4,644,610 | A * | 2/1987 | Fish | 24/30.5 S |
| 5,307,585 | A * | 5/1994 | Thompson | 43/21.2 |
| 5,484,056 | A * | 1/1996 | Wood | 206/349 |
| 5,669,515 | A * | 9/1997 | Tisbo et al. | 211/70.6 |
| 5,687,856 | A * | 11/1997 | Kendrena | 211/70.6 |
| D394,775 | S * | 6/1998 | Anderson et al. | D6/574 |
| 5,996,818 | A * | 12/1999 | Boje et al. | 211/74 |
| 6,305,557 | B1 * | 10/2001 | Brooks | 211/70.6 |
| 6,364,135 | B1 * | 4/2002 | Sirois et al. | 211/64 |
| D458,070 | S * | 6/2002 | Bennett et al. | D6/567 |
| 6,474,482 | B2 * | 11/2002 | Manix et al. | 211/70.6 |
| 6,481,583 | B1 * | 11/2002 | Black et al. | 211/70.6 |
| 6,508,369 | B2 * | 1/2003 | Wang | 211/60.1 |
| 6,626,402 | B1 * | 9/2003 | Kaminstein | 248/110 |

* cited by examiner

*Primary Examiner*—Robert W. Gibson, Jr.
(74) *Attorney, Agent, or Firm*—Charles E. Baxley

(57) ABSTRACT

A combination suspension rack includes a base portion, and two receiving portions each formed on the base portion. Each of the two receiving portions has an insertion hole having a wall formed with a plurality of elastic clamping plates. Thus, the tool, such as the screwdriver, is inserted into the receiving portion of the combination suspension rack easily and conveniently, thereby facilitating the user's use. In addition, the screwdriver is closely positioned on the receiving portion of the combination suspension rack rigidly and stably, thereby providing an efficient positioning effect.

13 Claims, 7 Drawing Sheets

COMBINATION SUSPENSION RACK

BACKGROUND OF THE INVENTION

1. Field of the Invention

The present invention relates to a combination suspension rack, and more particularly to a combination suspension rack, wherein the tool, such as the screwdriver, is inserted into the receiving portion of the combination suspension rack easily and conveniently, thereby facilitating the user's use.

2. Description of the Related Art

In general, the tools, such as the screwdrivers, are contained in the tool box. In operation, the screwdrivers are taken out of the tool box when in use. However, the tool box usually contains many tools therein, so that the user has to spend much time to find the required tools in the tool box, thereby causing inconvenience to the user. In addition, the tool box occupies larger space, thereby causing inconvenience in storage and transportation.

SUMMARY OF THE INVENTION

The primary objective of the present invention is to provide a combination suspension rack, wherein the tool, such as the screwdriver, is inserted into the receiving portion of the combination suspension rack easily and conveniently, thereby facilitating the user's use.

Another objective of the present invention is to provide a combination suspension rack, wherein any two combination suspension racks are combined with each other rigidly and stably without detachment by engagement of the first snap portion and the second snap portion.

A further objective of the present invention is to provide a combination suspension rack, wherein any two combination suspension racks are combined with each other easily, rapidly and conveniently by engagement of the first overlap portion and the second overlap portion, thereby facilitating assembly and disassembly of the combination suspension rack.

A further objective of the present invention is to provide a combination suspension rack, wherein the screwdriver is closely positioned on the two receiving portions of the combination suspension rack rigidly and stably, thereby providing an efficient positioning effect.

In accordance with the present invention, there is provided a combination suspension rack, comprising:

a base portion; and two receiving portions each formed on the base portion, each of the two receiving portions has an insertion hole, the insertion hole of each of the two receiving portions has a wall formed with a plurality of elastic clamping plates.

Further benefits and advantages of the present invention will become apparent after a careful reading of the detailed description with appropriate reference to the accompanying drawings.

DETAILED DESCRIPTION OF THE INVENTION

Figure 1:
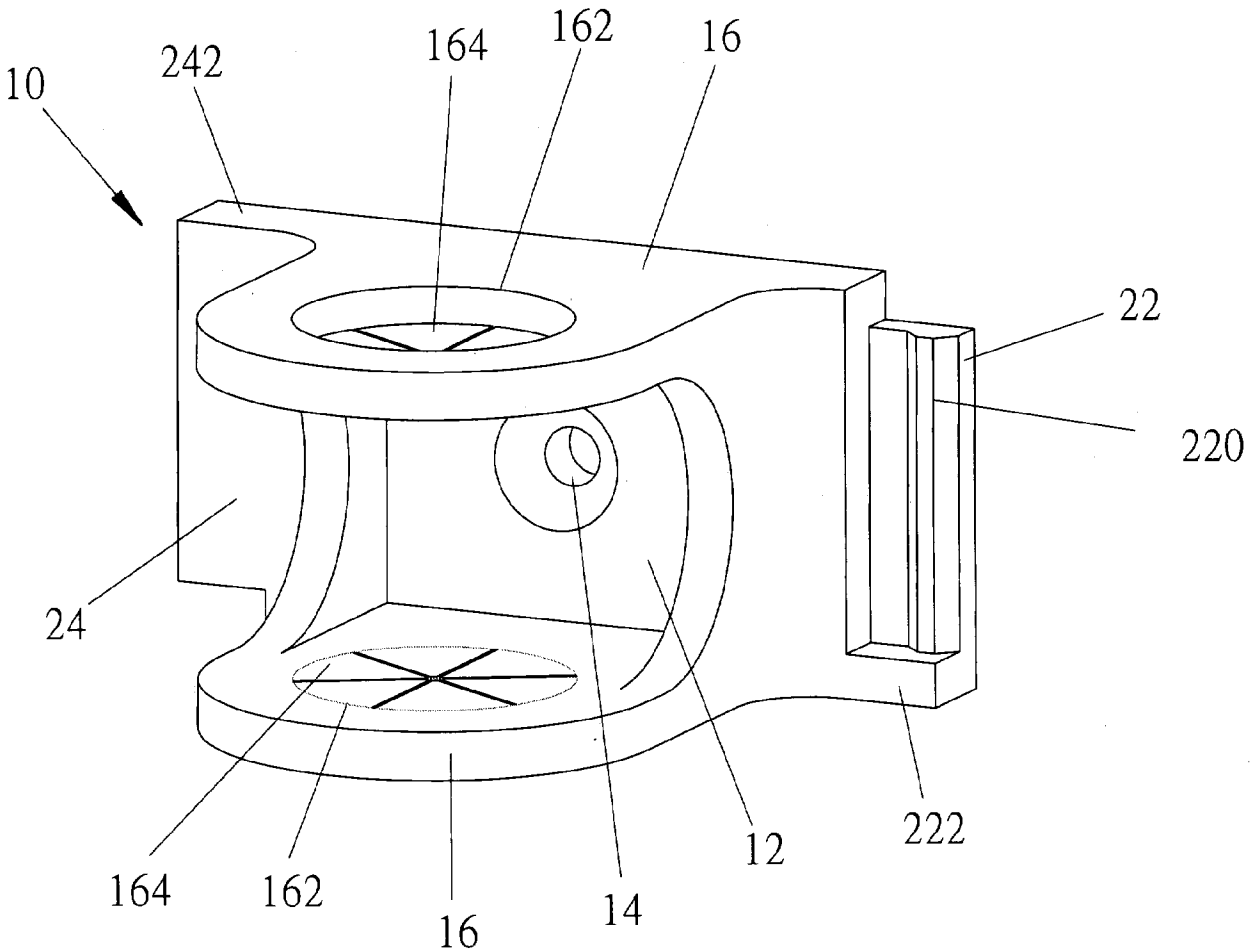
FIG. 1 is a perspective view of a combination suspension rack in accordance with a first embodiment of the present invention.
Figure 2:
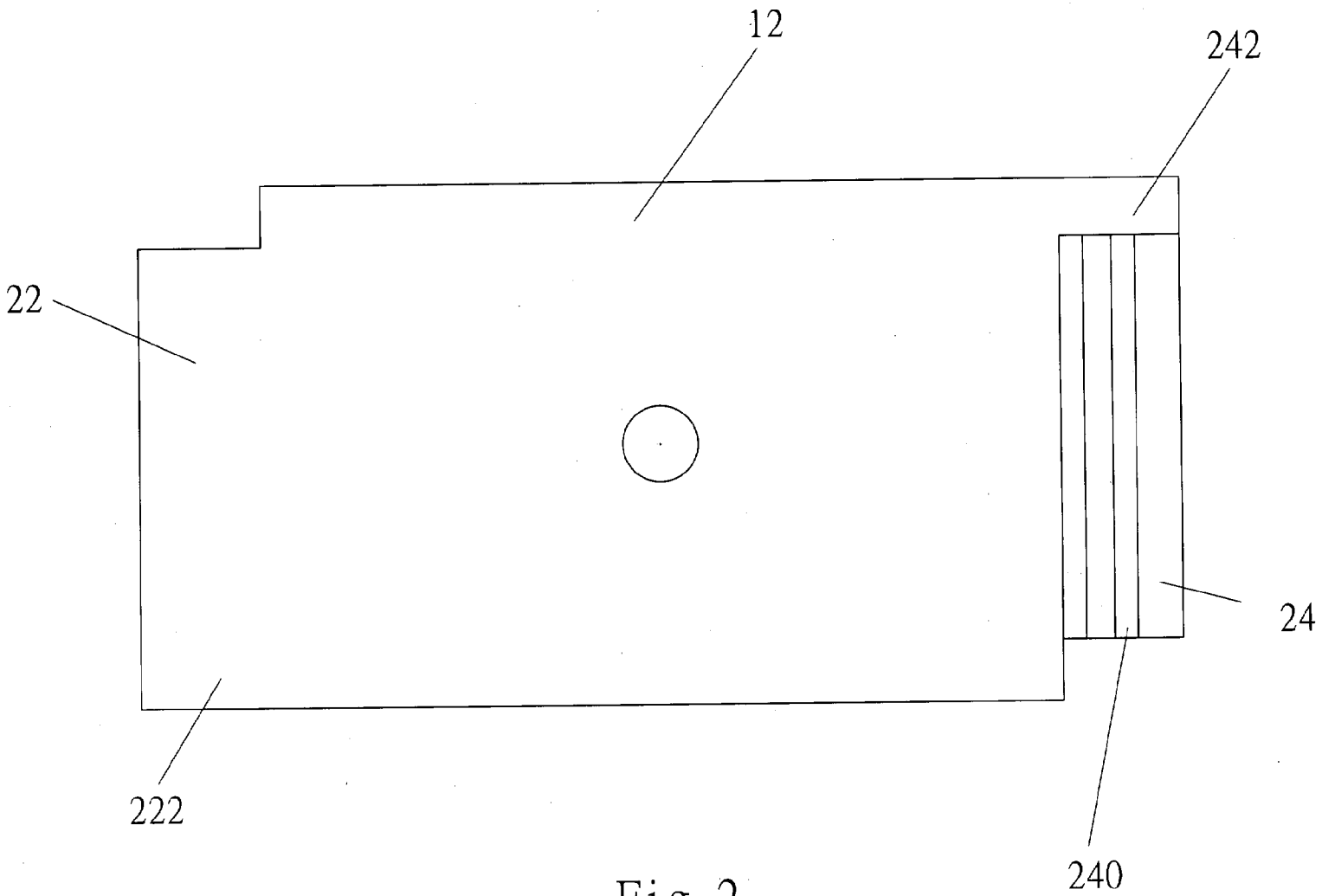
FIG. 2 is a rear plan view of the combination suspension rack in accordance with the first embodiment of the present invention.
Figure 3A:
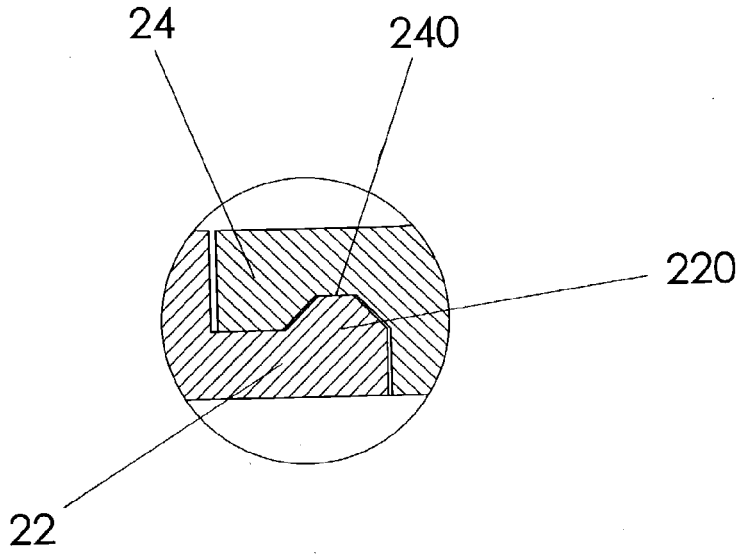
FIG. 3A is a partially enlarged view of the combination suspension rack as shown in FIG. 3.
Figure 3:
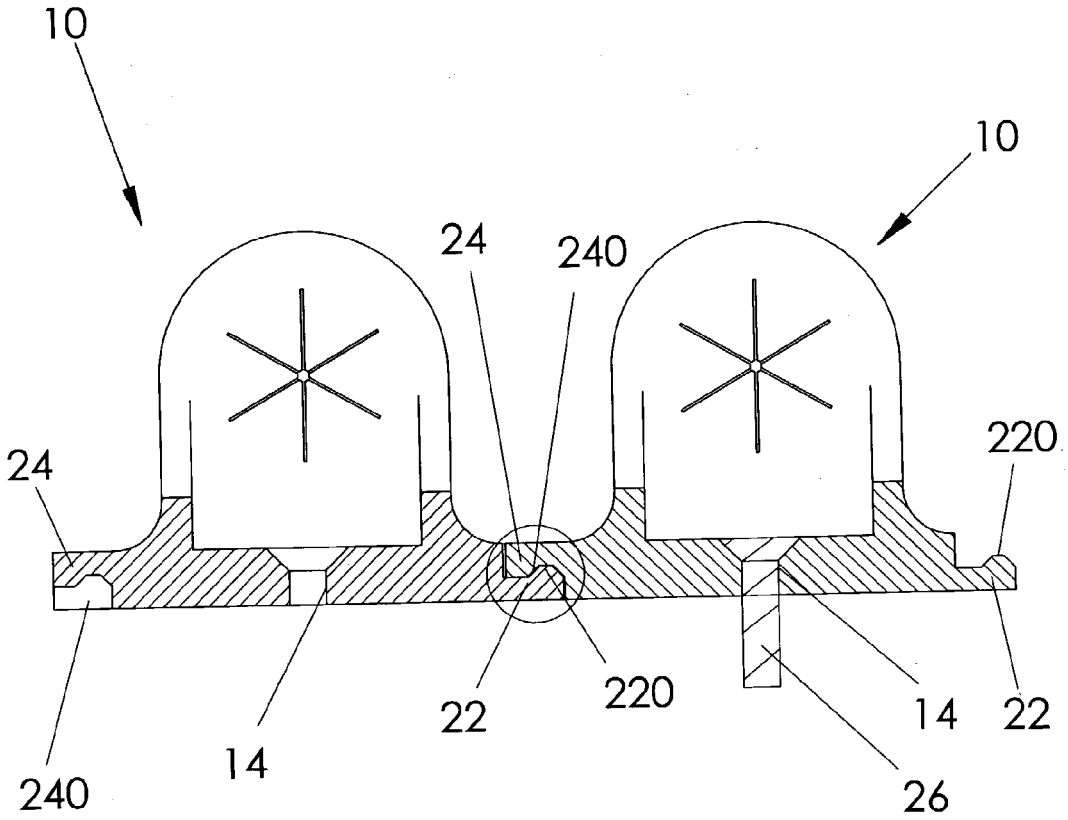
FIG. 3 is a top plan cross-sectional assembly view of two combination suspension racks in accordance with the first embodiment of the present invention.

Referring to the drawings and initially to FIGS. 1–3, a combination suspension rack 10 in accordance with a first embodiment of the present invention comprises a base portion 12 having a center formed with a through hole 14. The base portion 12 has a sheet shape.

The combination suspension rack 10 further comprises two receiving portions 16 each formed on the base portion 12. Preferably, the base portion 12 is integrally formed with the two receiving portions 16. The two receiving portions 16 are located on the top side and the bottom side of the base portion 12 respectively. The two receiving portions 16 are in parallel with each other. Each of the two receiving portions 16 is formed with an insertion hole 162. The insertion hole 162 of each of the two receiving portions 16 has a wall formed with a plurality of elastic clamping plates 164.

The combination suspension rack 10 further comprises a first overlap portion 22 formed on a first side of the base portion 12 and a second overlap portion 24 formed on a second side of the base portion 12.

The first overlap portion 22 is formed with an elongated combination hook 220. Preferably, the combination hook 220 of the first overlap portion 22 has a dovetail shape. In addition, the first overlap portion 22 has an end portion formed with a first catch 222.

The second overlap portion 24 is formed with an elongated combination recess 240. Preferably, the combination recess 240 of the second overlap portion 24 has a dovetail shape. In addition, the second overlap portion 24 has an end portion formed with a second catch 242.

Referring, to FIGS. 3 and 3A, two combination suspension racks 10 are combined with each other, wherein a fixing member 26 is extended through the through hole 14 of the base portion 12 of one of the two combination suspension racks 10 for positioning the two combination suspension racks 10.

In addition, the combination hook 220 of the first overlap portion 22 of one of the two combination suspension racks 10 is locked in the combination recess 240 of the second overlap portion 24 of the other one of the two combination suspension racks 10, so that the two combination suspension racks 10 are combined with each other.

It is appreciated that, when the two combination suspension racks 10 are combined, the first overlap portion 22 and the first catch 222 of one of the two combination suspension racks 10 is rested on the second catch 242 and the second overlap portion 24 of the other one of the two combination suspension racks 10 respectively, so that the two combination suspension racks 10 are combined with each other rigidly and stably without detachment.

Figure 4:
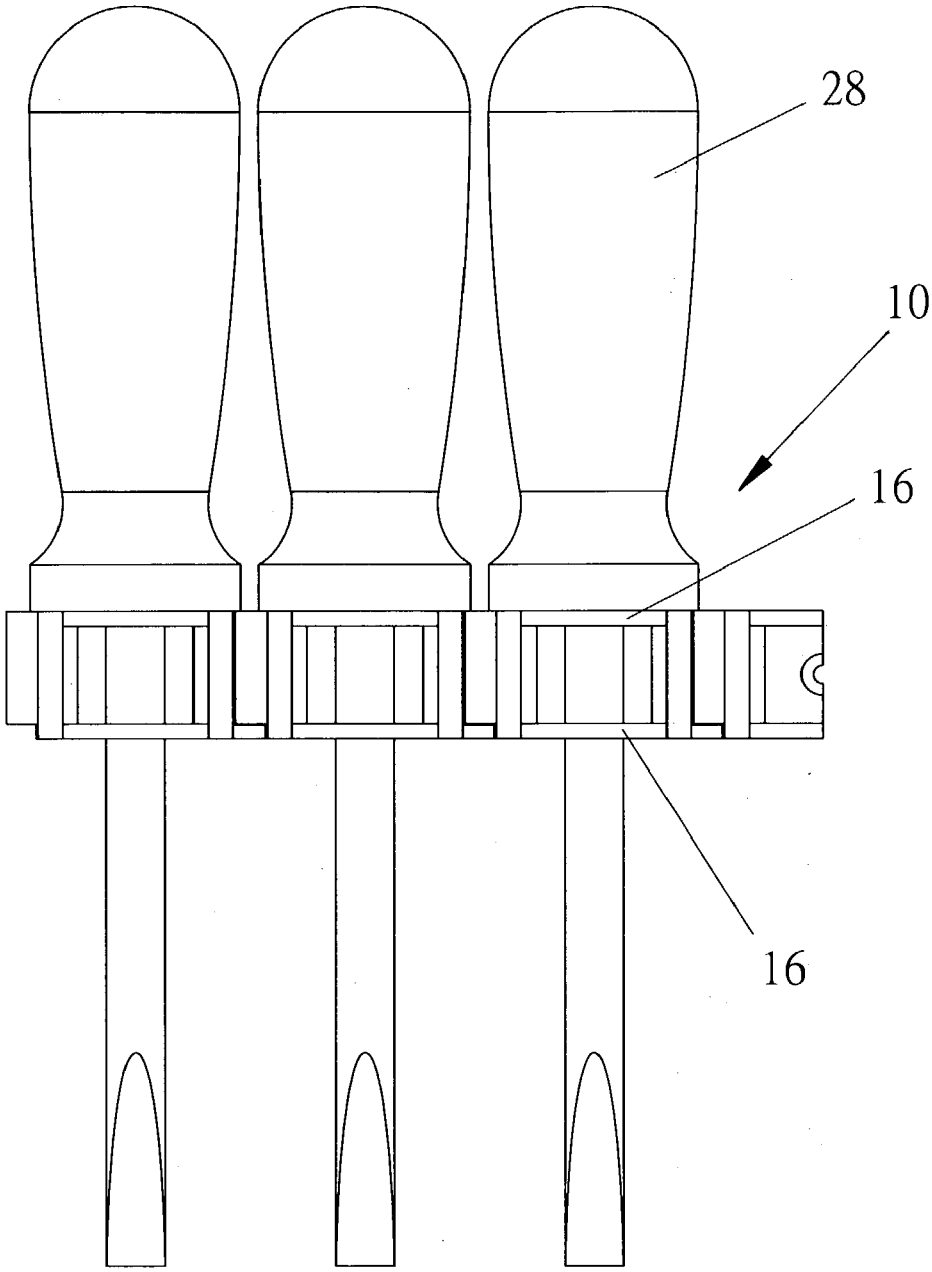
FIG. 4 is a side plan assembly view of a plurality of combination suspension racks in accordance with the first embodiment of the present invention.

As shown in FIG. 4, the screwdriver 28 is inserted into the insertion hole 162 of each of the two receiving portions 16 of each of the combination suspension racks 10 and is clamped by the respective elastic clamping plates 164, so that the screwdriver 28 is closely positioned on the two receiving portions 16 of each of the combination suspension racks 10 rigidly and stably.

Figure 5:
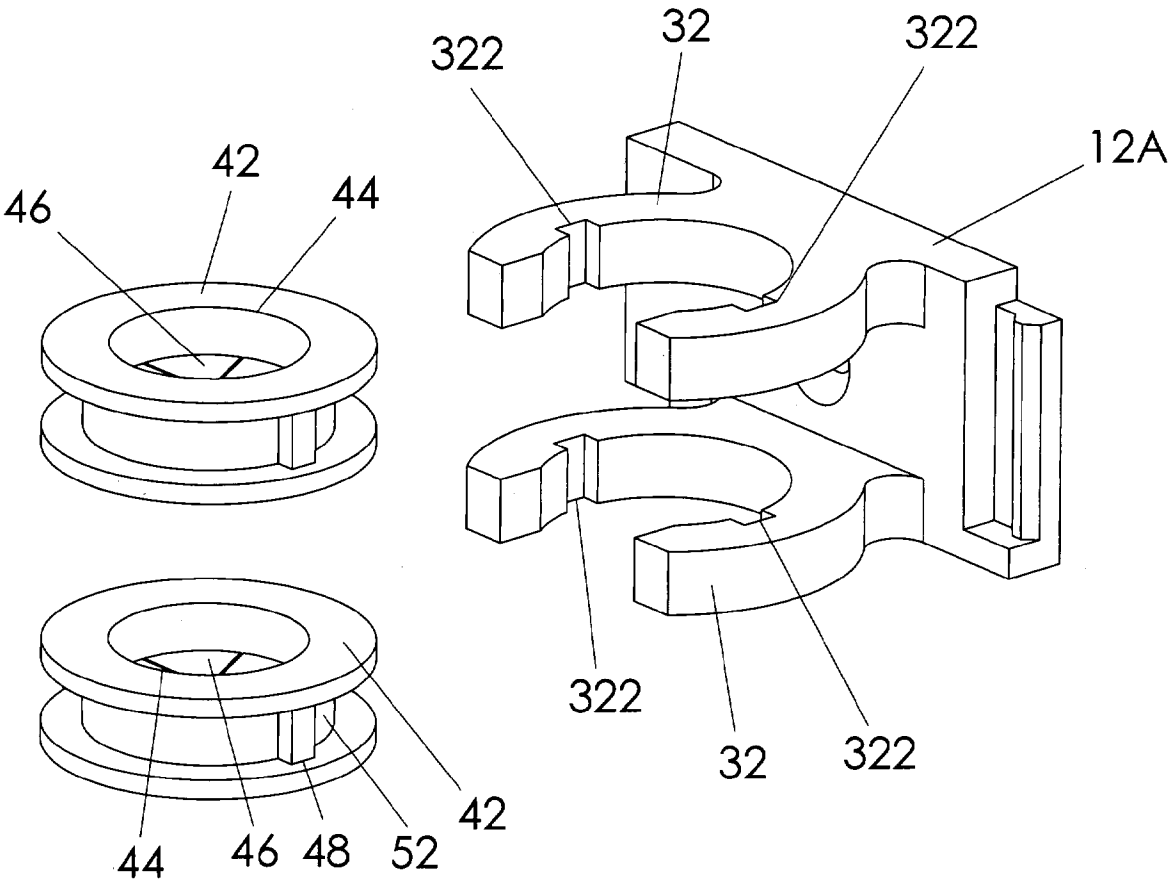
FIG. 5 is an exploded perspective view of a combination suspension rack in accordance with a second embodiment of the present invention.
Figure 6:
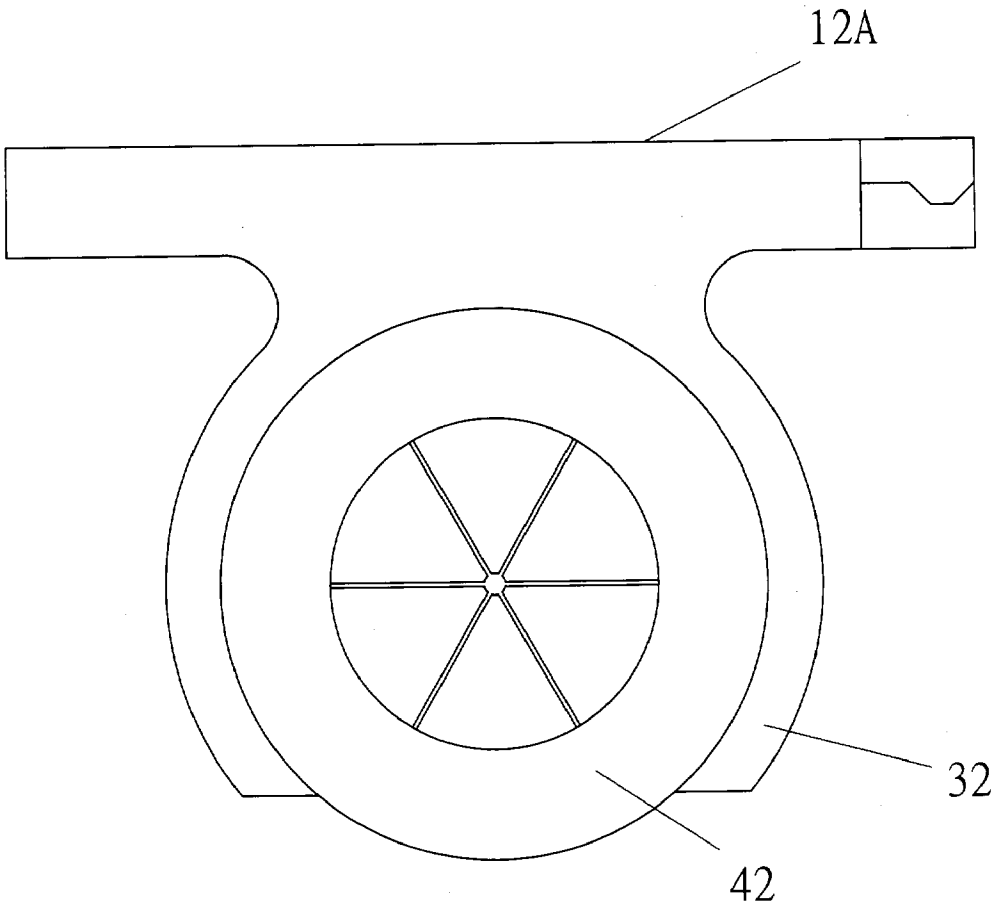
FIG. 6 is a top plan assembly view of the combination suspension rack as shown in FIG. 5.
Figure 7:
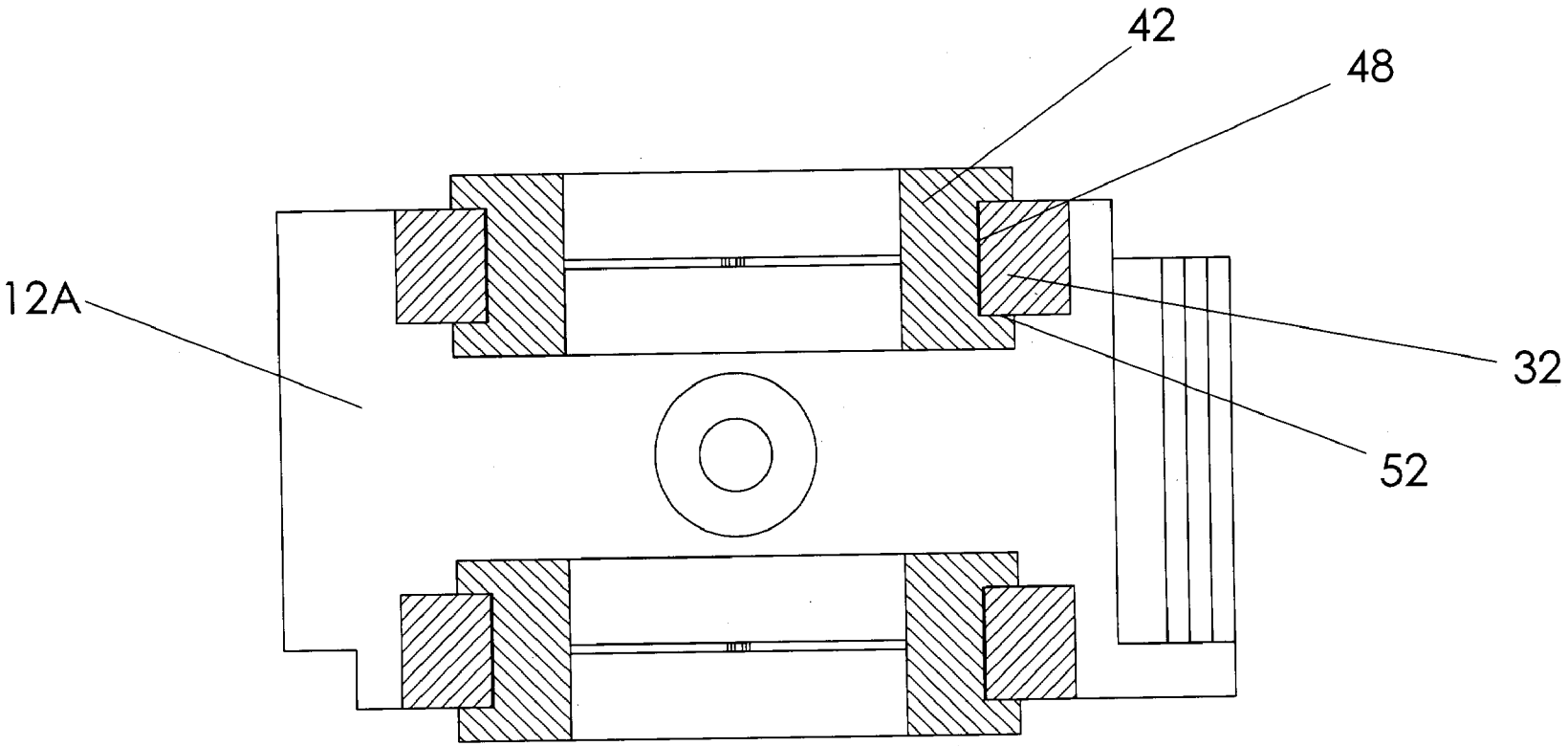
FIG. 7 is a front plan cross-sectional assembly view of the combination suspension rack as shown in FIG. 5.

Referring to FIGS. 5–7, the combination suspension rack in accordance with a second embodiment of the present invention comprises a base portion 12A, and two receiving portions each formed on the base portion 12A. The two receiving portions are located on the top side and the bottom side of the base portion 12A respectively. The two receiving portions are in parallel with each other.

Each of the two receiving portions includes a clamping arm 32 formed on the base portion 12A, and a receiving unit 42 secured on the clamping arm 32. Preferably, the clamping arm 32 of each of the two receiving portions is substantially C-shaped, and the receiving unit 42 of each of the two receiving portions is substantially circular shaped. The clamping arm 32 of each of the two receiving portions has an inner face formed with two opposite locking holes 322.

The receiving unit 42 of each of the two receiving portions has an inner wall formed with an insertion hole 44. The insertion hole 44 of the receiving unit 42 of each of the two receiving portions 16 has a wall formed with a plurality of elastic clamping plates 46. The receiving unit 42 of each of the two receiving portions has an outer wall formed with an annular locking groove 52 for locking the respective clamping arm 32. The locking groove 52 of the receiving unit 42 of each of the two receiving portions has a periphery formed with two opposite locking blocks 48 each locked in a respective one of the two opposite locking holes 322 of the respective clamping arm 32.

Thus, the clamping arm 32 of each of the two receiving portions is locked in the locking groove 52 of the respective receiving unit 42, and each locking block 48 of the receiving unit 42 of each of the two receiving portions is locked in the respective locking hole 322 of the respective clamping arm 32, so that the receiving unit 42 is combined with the respective clamping arm 32 rigidly and stably.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A combination suspension rack, comprising:

a base portion;

a first overlap portion formed on a first side of the base portion;

a second overlap portion formed on a second side of the base portion;

two receiving portions each formed on the base portion, each of the two receiving portions having an insertion hole, the insertion hole of each of the two receiving portions having a wall formed with a plurality of elastic clamping plates;

wherein the two receiving portions are located on a top side and a bottom side of the base portion respectively.

2. The combination suspension rack in accordance with claim 1, wherein the base portion has a center formed with a through hole.

3. The combination suspension rack in accordance with claim 1, wherein the two receiving portions are in parallel with each other.

4. The combination suspension rack in accordance with claim 1, wherein the base portion is integrally formed with the two receiving portions.

5. A combination suspension rack, comprising:

a base portion;

a first overlap portion formed on a first side of the base portion;

a second overlap portion formed on a second side of the base portion;

two receiving portions each formed on the base portion, each of the two receiving portions having an insertion hole, the insertion hole of each of the two receiving portions having a wall formed with a plurality of elastic clamping plates;

wherein the first overlap portion is formed with an elongated combination hook, and the second overlap portion is formed with an elongated combination recess.

6. The combination suspension rack in accordance with claim 5, wherein the combination hook of the first overlap portion has a dovetail shape, and the combination recess of the second overlap portion has a dovetail shape.

7. The combination suspension rack in accordance with claim 1, wherein the first overlap portion has an end portion formed with a first catch, and the second overlap portion has an end portion formed with a second catch.

8. The combination suspension rack in accordance with claim 5, wherein the combination hook of the first overlap portion of one of two combination suspension racks is locked in the combination recess of the second overlap portion of the other one of the two combination suspension racks, so that the two combination suspension racks are combined with each other.

9. The combination suspension rack in accordance with claim 7, wherein first overlap portion and the first catch of one of two combination suspension racks is rested on the second catch and the second overlap portion of the other one of the two combination suspension racks respectively.

10. A combination suspension rack, comprising:

a base portion; and two receiving portions each formed on the base portion, each of the two receiving portions having an insertion hole, the insertion hole of each of the two receiving portions having a wall formed with a plurality of elastic clamping plates, wherein each of the two receiving portions includes a clamping arm formed on the base portion, and a receiving unit secured on the clamping arm;

the clamping arm of each of the two receiving portions is substantially C-shaped, and the receiving unit of each of the two receiving portions is substantially circular shaped.

11. The combination suspension rack in accordance with claim 10, wherein the insertion hole is formed in the receiving unit of each of the two receiving portions.

12. The combination suspension rack in accordance with claim 10, wherein the receiving unit of each of the two receiving portions has an outer wall formed with an annular locking groove for locking the respective clamping arm.

13. The combination suspension rack in accordance with claim 12, wherein the clamping arm of each of the two receiving portions has an inner face formed with two opposite locking holes, and the locking groove of the receiving unit of each of the two receiving portions has a periphery formed with two opposite locking blocks each locked in a respective one of the two opposite locking holes of the respective clamping arm.

* * * * *